US008850616B1

(12) United States Patent
Hoover et al.

(10) Patent No.: US 8,850,616 B1
(45) **Date of Patent: *Oct. 7, 2014**

(54) MOISTURE TRAPPING HEADBAND

(71) Applicants: Michele M. Hoover, St. Petersburgh, FL (US); Joseph Brooke Hoover, St. Petersburgh, FL (US)

(72) Inventors: Michele M. Hoover, St. Petersburgh, FL (US); Joseph Brooke Hoover, St. Petersburgh, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/078,898

(22) Filed: Nov. 13, 2013

Related U.S. Application Data

(63) Continuation-in-part of application No. 12/807,731, filed on Sep. 13, 2010, now Pat. No. 8,661,567, which is a continuation-in-part of application No. 12/384,226, filed on Apr. 2, 2009, now abandoned.

(51) Int. Cl.
*A41D 20/00* (2006.01)
*A42C 5/02* (2006.01)

(52) U.S. Cl.
CPC ..... *A42C 5/02* (2013.01)
USPC ..... 2/170

(58) Field of Classification Search
USPC ..... 2/16, 170, 171, 162, 918, DIG. 11; 602/20–23
See application file for complete search history.

(56) References Cited

U.S. PATENT DOCUMENTS

| | | | | |
|---|---|---|---|---|
| 4,832,010 | A * | 5/1989 | Lerman | 602/63 |
| 4,896,378 | A * | 1/1990 | Campana | 2/170 |
| 4,947,488 | A * | 8/1990 | Ashinoff | 2/181 |
| 5,329,638 | A * | 7/1994 | Hansen et al. | 2/16 |
| 6,425,137 | B1 * | 7/2002 | Fakhrai | 2/170 |
| 8,661,567 | B1 * | 3/2014 | Hoover et al. | 2/170 |

* cited by examiner

*Primary Examiner* — Tejash Patel

(57) ABSTRACT

An exterior layer is fabricated of a moisture transferring material having inner and outer surfaces. An interior layer is fabricated of a moisture transferring material having inner and outer surfaces adjacent to at least a portion of the exterior layer and forming a periphery. A chamber is formed between the interior layer and the exterior layer. An intermediate layer is within the chamber at a central location in pressure contact with the interior layer. The intermediate layer has inner and outer surfaces. The intermediate layer is fabricated of a moisture trapping and containing material. Stitching couples the interior and exterior layers adjacent to the periphery. The stitching also couples the intermediate layer to the interior and exterior layers at a fixed location within the chamber.

8 Claims, 5 Drawing Sheets

FIG 1
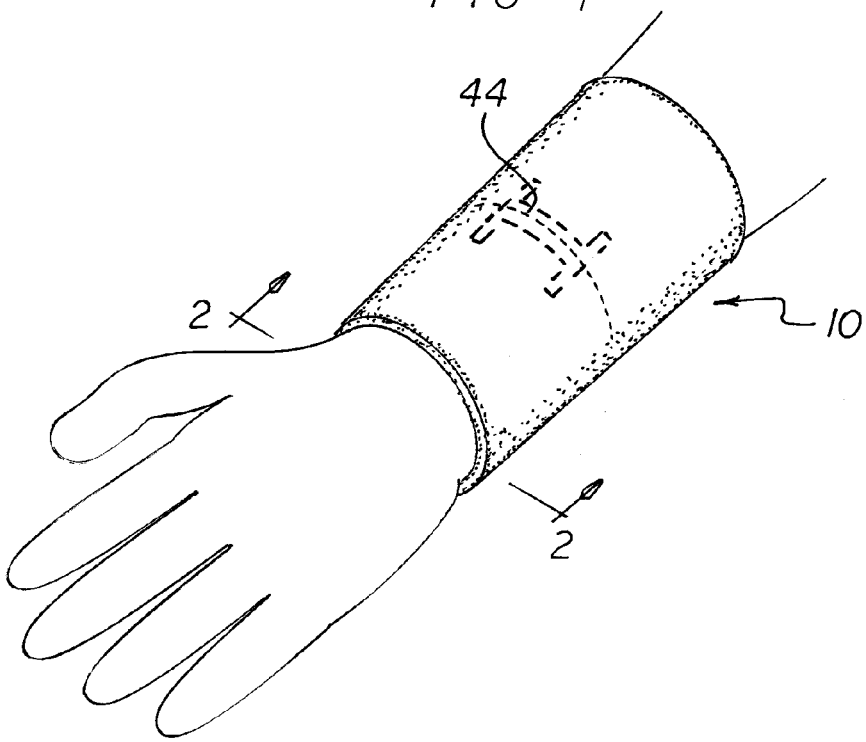
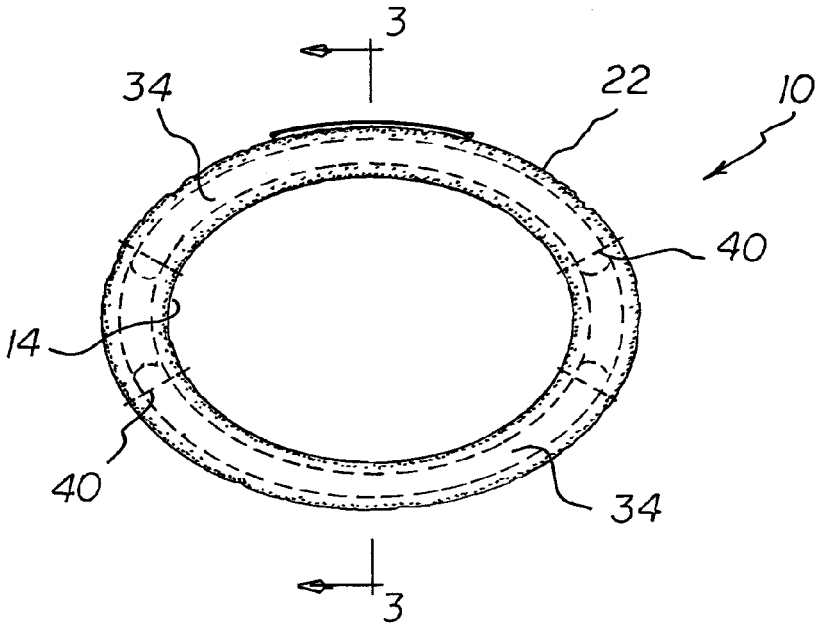
FIG 2

FIG 3
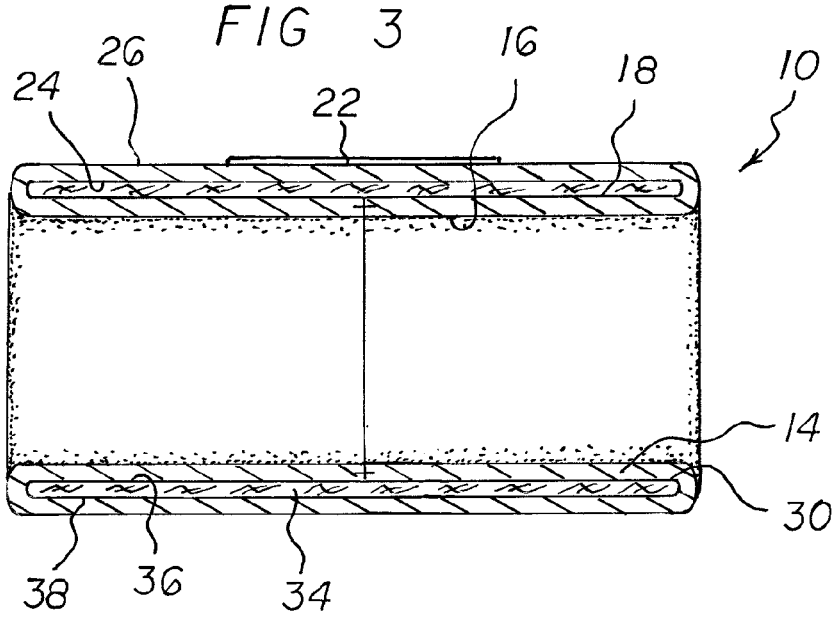
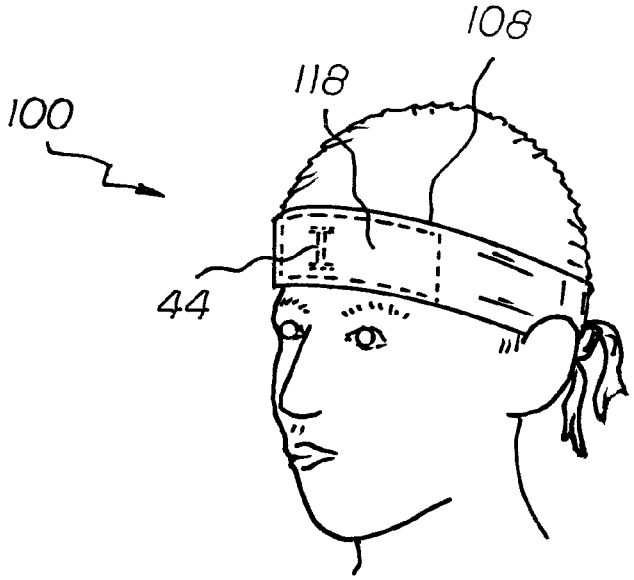
FIG. 4

MOISTURE TRAPPING HEADBAND

RELATED APPLICATION

This application is a continuation-in-part of pending U.S. patent application Ser. No. 12/807,731 filed Sep. 13, 2010, which is a continuation-in-part of Ser. No. 12/384,226 filed Apr. 2, 2009, the subject matter of which applications is incorporated herein by reference.

BACKGROUND OF THE INVENTION

Field of the Invention

The present invention relates to an athletic headband and more particularly pertains to conducting sweat away from a user wearing the headband and for trapping and containing such conducted sweat, the conducting and trapping and containing being achieved in a safe, convenient and economical manner.

SUMMARY OF THE INVENTION

In view of the disadvantages inherent in the known types of moisture handling headbands of known designs and configurations now present in the prior art, the present invention provides an improved moisture trapping headband. As such, the general purpose of the present invention, which will be described subsequently in greater detail, is to provide a new and improved moisture trapping headband and method which has all the advantages of the prior art and none of the disadvantages.

To attain this, the present invention essentially comprises a moisture trapping headband. An exterior layer is fabricated of a moisture transferring material having inner and outer surfaces. An interior layer is fabricated of a moisture transferring material having inner and outer surfaces adjacent to at least a portion of the exterior layer and forming a periphery. A chamber is formed between the interior layer and the exterior layer. An intermediate layer is within the chamber at a central location in pressure contact with the interior layer. The intermediate layer has inner and outer surfaces. The intermediate layer is fabricated of a moisture trapping and containing material. Stitching couples the interior and exterior layers adjacent to the periphery. The stitching also couples the intermediate layer to the interior and exterior layers at a fixed location within the chamber.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and headbands for carrying out the several purposes of the present invention. It is important, therefore, that the claims be regarded as including such equivalent constructions insofar as they do not depart from the spirit and scope of the present invention.

It is therefore an object of the present invention to provide a new and improved moisture trapping headband which has all of the advantages of the prior art sweat management headbands of known designs and configurations and none of the disadvantages.

It is another object of the present invention to provide a new and improved moisture trapping headband which may be easily and efficiently manufactured and marketed.

It is further object of the present invention to provide a new and improved moisture trapping headband which is of durable and reliable constructions.

An even further object of the present invention is to provide a new and improved moisture trapping headband which is susceptible of a low cost of manufacture with regard to both materials and labor, and which accordingly is then susceptible of low prices of sale to the consuming public, thereby making such moisture trapping headband economically available to the buying public.

Lastly, it is an object of the present invention to provide a new and improved moisture trapping headband including an interior layer, an exterior layer and an intermediate layer, the headband being adapted for conducting sweat away from a user wearing the headband and for trapping and containing such conducted sweat, the conducting and trapping and containing being achieved in a safe, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a moisture trapping device constructed in accordance with the principles of the present invention.

FIG. 2 is a cross sectional view taken along line 2-2 of FIG. 1.

FIG. 3 is a cross sectional view taken along line 3-3 of FIG. 2.

front elevational view of the headband shown in FIG. 4.

FIG. 4 is a perspective showing of a headband tied to a wearer illustrating an alternate embodiment of the invention.

Figure 5:
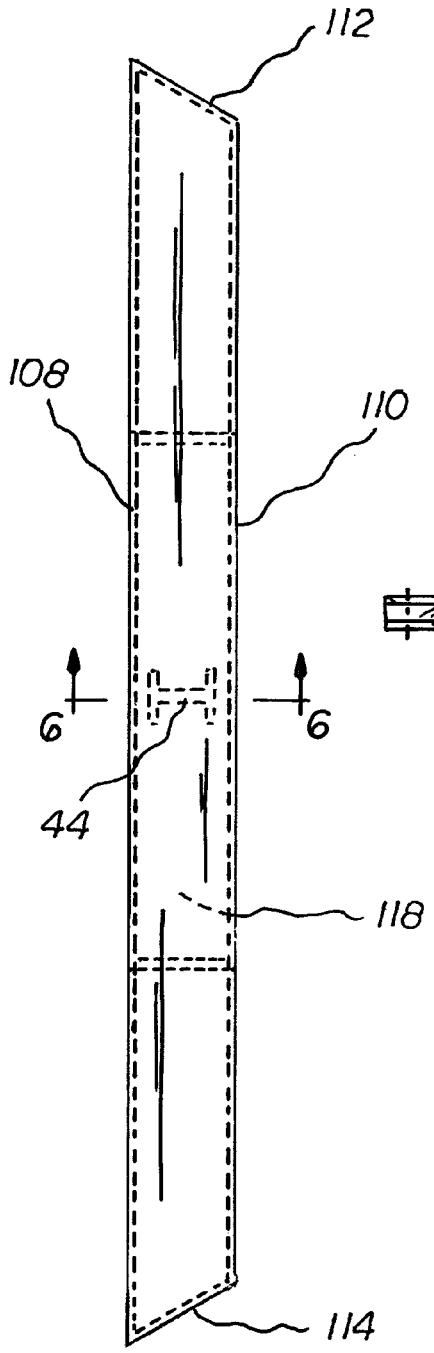

FIG. 5 is a front elevational view of the headband shown in FIG. 4.

Figure 6:
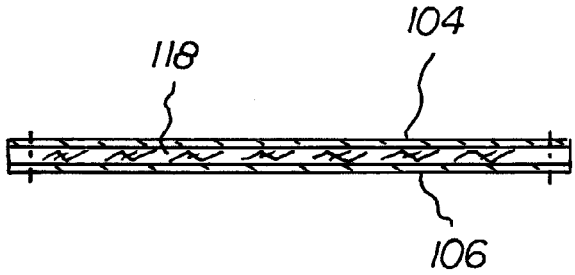

FIG. 6 is a cross sectional view taken along line 6-6 of FIG. 5.

Figures 7, 8, 9:
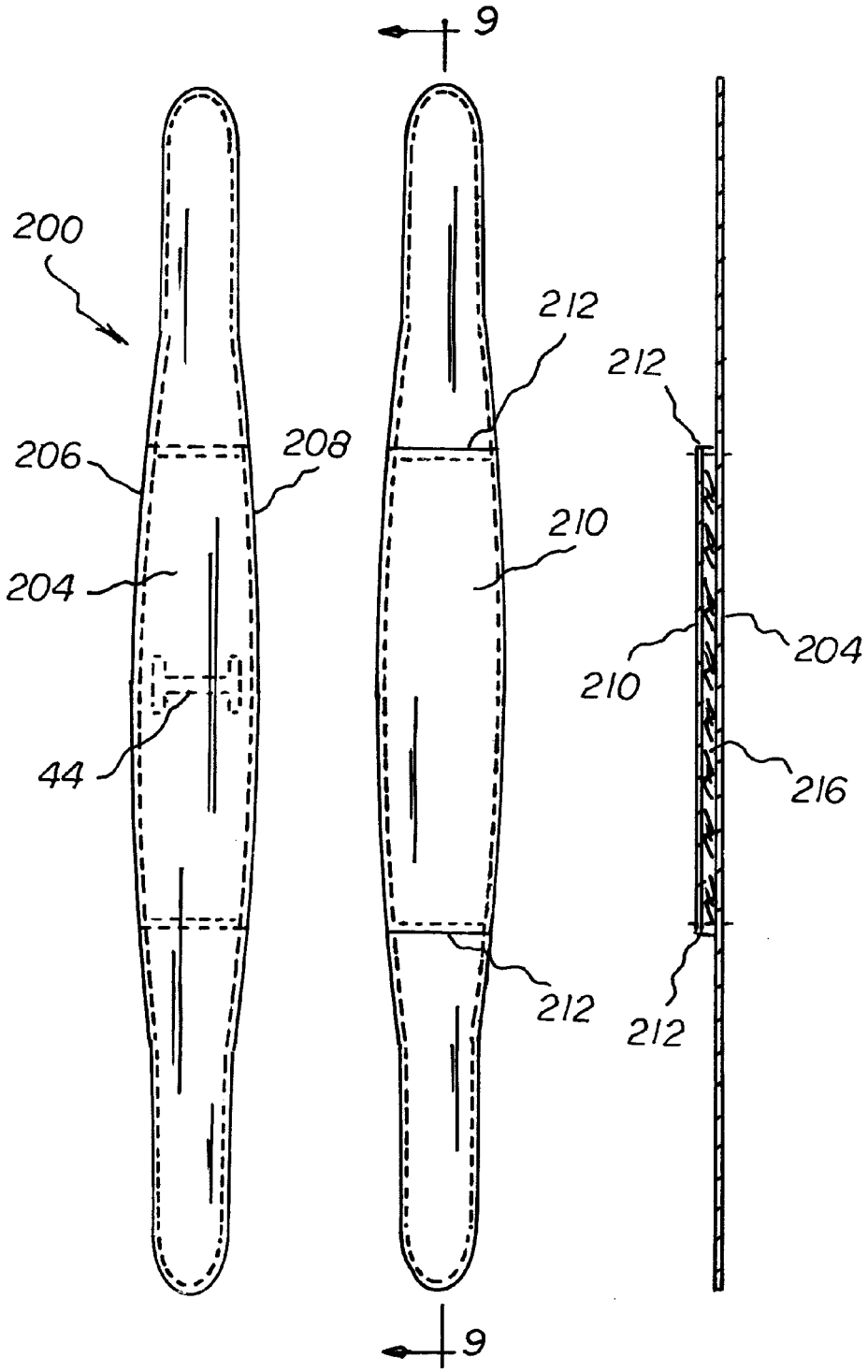

FIGS. 7 and 8 are front and rear elevational views of a headband constructed in accordance with another alternate embodiment of the invention.

FIG. 9 is a cross sectional view taken along line 9-9 of FIG. 8.

Figure 10:
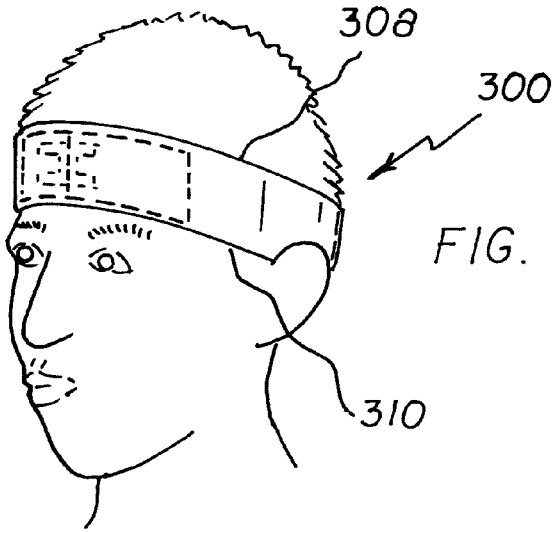

FIG. 10 is a perspective illustration of a final alternate embodiment of the invention resiliently held on a wearer's head.

Figure 11:
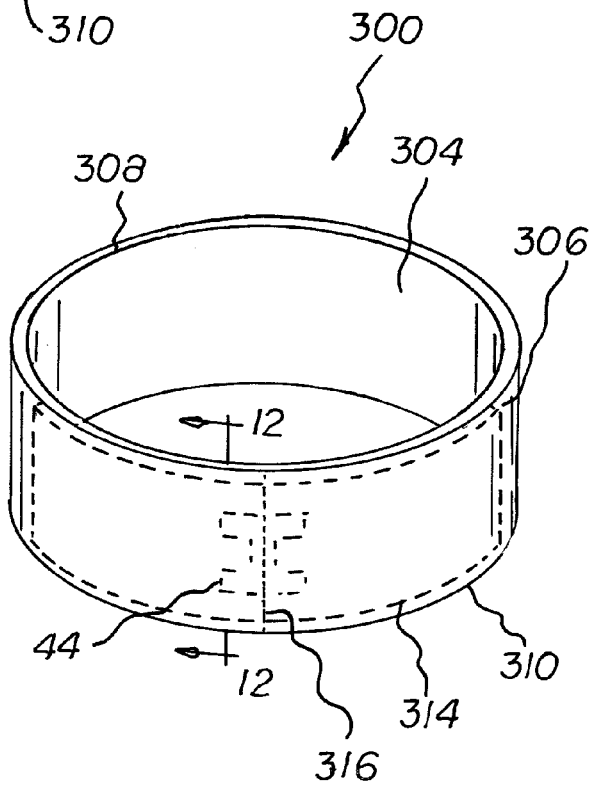

FIG. 11 is a perspective illustration of the headband shown in FIG. 10.

Figure 12:
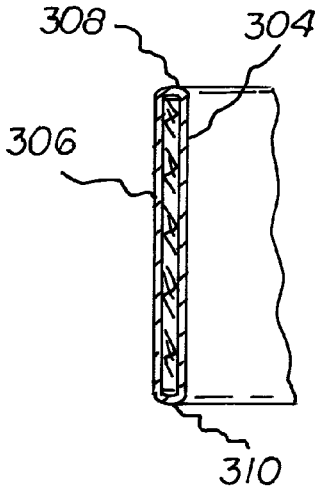

FIG. 12 is a cross sectional view taken along line 12-12 of FIG. 11.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved moisture trapping headband embodying the principles and concepts of the present invention and generally designated by the reference numeral 10 will be described.

The present invention, the present moisture trapping invention 10 is comprised of a plurality of components. Such components in their broadest context include an interior layer, an exterior layer, a chamber and an intermediate layer. Such components are individually configured and correlated with respect to each other so as to attain the desired objective.

First provided is an exterior layer 22. The exterior layer is fabricated of a moisture transferring material. The exterior layer has inner and outer surfaces 24, 26.

Next provided is an interior layer 14. The interior layer is also fabricated of a moisture transferring material having inner and outer surfaces 16, 18. The interior layer is located adjacent to at least a portion of the exterior layer. The interior and exterior layers form a periphery.

As may be seen in FIG. 3, a chamber 30 is formed between the exterior surface of the interior layer and the interior layer of the exterior layer.

An intermediate layer 34 is provided within the chamber at a central location. The intermediate layer is in pressure contact with the interior layer. The intermediate layer has two spaced panels with inner and outer surfaces 36, 38. The intermediate layer is preferably fabricated of 100 percent viscose rayon, a moisture trapping and containing material.

In the preferred embodiment, the interior and exterior layers are fabricated of a blend of between about 90 and 94 percent polyester and between 7 and 9 percent Lycra.

Stitching 40 couples the interior and exterior layers adjacent to the periphery. The stitching also coupling the intermediate layer to the interior and exterior layers at a fixed location within the chamber.

Circumferential spacings are formed between the panels of the intermediate layer. The spacings constituting between 5 and 15 percent of the circumference of the invention. Such spacings allow for stretching of the headband to facilitate putting on and taking off.

Indicia 44 is formed on the outer surface of the exterior layer overlying a central extent of the intermediate layer. The indicia functions to facilitate proper position of the invention on the user.

An alternate embodiment 100 is illustrated in FIGS. 4-6. In such embodiment, the system is a headband adapted to be supported on a user by being tied at the back of a user's head. In this embodiment, the interior and exterior layers 104, 106 are trapezoidal. The interior and exterior layers have parallel linear upper and lower edges 108, 110. The interior and exterior layers are have linear end edges 112, 114. The upper edge have a length of from 33.5 to 34.5 inches. The lower edge has a length of from 31.5 to 32.5 inches. The upper and lower edges are separated by a height of from 2.25 to 3.75 inches.

The intermediate layer 118 has a length of from 10 to 14 inches and a height essentially equal to the height of the interior and exterior layers.

Reference is now made to the alternate embodiment 200 as illustrated in FIGS. 7, 8 and 9. In such embodiment, the exterior layer 204 has a curving upper edge 206 and a curving lower edge 208 and arcuate ends. The headband includes a central mid-line between the upper and curving lower edge. The interior layer 210 has linear ends 212. A central mid-line in the interior layer has a length of from 10 to 14 inches. The upper and lower edges are separated by a maximum height of from 2.25 to 3.75 inches.

The intermediate layer 216 has a curving upper edge and a curving lower edge and a central mid-line co-extensive with the central mid-line of the exterior layer. The intermediate layer has linear ends. The central mid-line of the intermediate layer has a length of from 10 to 14 inches, the upper and lower edges being separated by a maximum height of from 2.25 to 3.75 inches.

Headband 300, a final alternate embodiment of the invention, is illustrated in FIGS. 10-12. In such embodiment, the interior and exterior layers 304, 306 are elastic and formed into a toroid shaped. The interior and exterior layers have circular upper and lower edges 308, 310. The upper and lower edges each forming a diameter of from 22 to 26 inches when unstretched. The upper and lower edges are separated by a height of from 2.25 to 3.75 inches.

The intermediate member has a length of from 10 to 14 inches. The intermediate layer has a height essentially equal to the height of the interior and exterior layers. Stitching 314, 316 couples the intermediate member to the interior and exterior layers. The inelastic characteristic of the intermediate layer, when stitched to the interior and exterior layers, abates the elasticity of the interior and exterior layers adjacent to the intermediate layer but facilitated the elasticity of the interior and exterior layer remote from the intermediate layer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A moisture trapping headband (10) comprising:

an exterior layer (22) fabricated of a moisture transferring material having inner and outer surfaces (24) (26);

an interior layer (14) fabricated of a moisture transferring material having inner and outer surfaces (16) (18) adjacent to at least a portion of the exterior layer and forming a periphery a chamber (30) formed between the interior layer and the exterior layer;

an intermediate layer (34) within the chamber at a central location in pressure contact with the interior layer, the intermediate layer having inner and outer surfaces (36) (38), the intermediate layer being fabricated of a moisture trapping and containing material fabricated of 100 percent viscose rayon; and stitching (40) coupling the interior and exterior layers adjacent to the periphery, the stitching also coupling the intermediate layer to the interior and exterior layers at a fixed location within the chamber.

2. A moisture trapping headband (100) comprising:

an exterior layer (106) fabricated of a moisture transferring material having inner and outer surfaces (24) (26);

an interior layer (104) fabricated of a moisture transferring material having inner and outer surfaces (16) (18) adjacent to at least a portion of the exterior layer and forming a periphery;

a chamber (30) formed between the interior layer and the exterior layer;

an intermediate layer (34) within the chamber at a central location in pressure contact with the interior layer, the intermediate layer having inner and outer surfaces (36) (38), the intermediate layer being fabricated of a moisture trapping and containing material;

stitching (40) coupling the interior and exterior layers adjacent to the periphery, the stitching also coupling the intermediate layer to the interior and exterior layers at a fixed location within the chamber;

wherein the interior and exterior layers (104) (106) are trapezoidal with parallel linear upper and lower edges (108) (110) and wherein the interior and exterior layers have linear end edges (112) (114), the upper edge having a length of from 33.5 to 34.5 inches, the lower edge having a length of from 31.5 to 32.5 inches, the upper and lower edges being separated by a height of from 2.25 to 3.75 inches.

3. A moisture trapping headband (200) comprising:

an exterior layer (204) fabricated of a moisture transferring material having inner and outer surfaces (24) (26);

an interior layer (210) fabricated of a moisture transferring material having inner and outer surfaces (16) (18) adjacent to at least a portion of the exterior layer and forming a periphery a chamber (30) formed between the interior layer and the exterior layer;

an intermediate layer (216) within the chamber at a central location in pressure contact with the interior layer, the intermediate layer having inner and outer surfaces (36) (38), the intermediate layer being fabricated of a moisture trapping and containing material; and stitching (40) coupling the interior and exterior layers adjacent to the periphery, the stitching also coupling the intermediate layer to the interior and exterior layers at a fixed location within the chamber;

wherein the exterior layer (204) has a curving upper edge (206) and a curving lower edge (208) and arcuate ends and a central mid-line between the upper and curving lower edge and wherein the interior layer (210) has linear ends (212) the central mid-line at the interior layer having a length of from 10 to 14 inches, the upper and lower edges being separated by a maximum height of from 2.25 to 3.75 inches.

4. The headband as set forth in claim 3 wherein the intermediate layer (216) has a curving upper edge and a curving lower edge and a central mid-line co-extensive with the central mid-line of the exterior layer and wherein the intermediate layer has linear ends the central mid-line of the intermediate layer has a length of from 10 to 14 inches, the upper and lower edges being separated by a maximum height of from 2.25 to 3.75 inches.

5. A moisture trapping headband (300) comprising:

an exterior layer (306) fabricated of a moisture transferring material having inner and outer surfaces (24) (26);

an interior layer (304) fabricated of a moisture transferring material having inner and outer surfaces (16) (18) adjacent to at least a portion of the exterior layer and forming a periphery a chamber (30) formed between the interior layer and the exterior layer;

an intermediate layer (34) within the chamber at a central location in pressure contact with the interior layer, the intermediate layer having inner and outer surfaces (36) (38), the intermediate layer being fabricated of a moisture trapping and containing material; and stitching (40) coupling the interior and exterior layers adjacent to the periphery, the stitching also coupling the intermediate layer to the interior and exterior layers at a fixed location within the chamber;

wherein the interior and exterior layers (304) (306) are elastic and formed into a toroid shaped with circular upper and lower edges (308) (310), the upper and lower edges each forming a diameter of from 22 to 26 inches, the upper and lower edges being separated by a height of from 2.25 to 3.75 inches.

6. The headband as set forth in claim 4 wherein the intermediate member has a length of from 10 to 14 inches and wherein the stitching (314) (316) couples the intermediate member to the interior and exterior layers whereby the intermediate layer abates the elasticity of the interior and exterior layers adjacent to the intermediate layer but facilitated the elasticity of the interior and exterior layer remote from the intermediate layer.

7. The headband as set forth in claim 5 wherein the interior and exterior layers are fabricated of knitted material.

8. The headband as set forth in claim 5 wherein the interior and exterior layers are woven from elastic threads.

* * * * *